US006847253B2

(12) United States Patent
Nam

(10) Patent No.: US 6,847,253 B2
(45) Date of Patent: Jan. 25, 2005

(54) HALF VOLTAGE GENERATOR HAVING LOW POWER CONSUMPTION

(75) Inventor: Jeong-Sik Nam, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/698,396

(22) Filed: Nov. 3, 2003

(65) Prior Publication Data

US 2004/0090262 A1 May 13, 2004

(30) Foreign Application Priority Data

Nov. 8, 2002 (KR) ..... 10-2002-69353

(51) Int. Cl.[7] ..... G05F 1/10; G05F 3/02
(52) U.S. Cl. ..... 327/543
(58) Field of Search ..... 327/538, 540, 327/541, 543

(56) References Cited

U.S. PATENT DOCUMENTS 5,592,119 A * 1/1997 Yoo ..... 327/530
5,610,550 A * 3/1997 Furutani ..... 327/543
5,757,225 A * 5/1998 Tobita ..... 327/539

FOREIGN PATENT DOCUMENTS

JP 04042313 A * 2/1992 ..... G05F/3/24

* cited by examiner

*Primary Examiner*—Quan Tra

(57) ABSTRACT

A half voltage generator includes input buffer unit that receives an input voltage and outputs control voltage and a reference voltage using a power supply voltage, and a voltage division unit that divides the power supply voltage in half and outputs the half power supply voltage in response the control voltage and reference voltage. A current mirror receives the reference voltage unit and current limits the operation of an output buffer unit, which is controlled by an output voltage of the voltage division unit to output the half power supply voltage. A push-pull driving unit is controlled by the output voltage of the output buffer unit to output the half power supply voltage, which has an improved current driving capacity, as a final output voltage.

21 Claims, 3 Drawing Sheets

HALF VOLTAGE GENERATOR HAVING LOW POWER CONSUMPTION

CROSS REFERENCES TO RELATED APPLICATIONS

This application claims priority under 35 U.S.C § 119 from Korean Patent Application No. 2002-69353, filed on Nov. 8, 2002, the contents of which are hereby incorporated by reference in their entirety for all purposes as if fully set forth herein.

BACKGROUND AND SUMMARY

1. Technical Field

The present invention relates to a half voltage generator, and more particularly, to a half voltage generator that generates half voltages used as a cell array power supply in a semiconductor memory device.

2. Description

Half voltages generated by half voltage generators are used as reference voltages for determining the signal quantity of charge in electrodes of a memory cell capacitor of a semiconductor memory device, such as a DRAM, or a precharge voltage for sufficiently charging bit lines or memory cells. In other cases, the half voltages may be used in a semiconductor integrated circuit requiring half voltages. However, as the operating speed of semiconductor integrated circuits is increased and they are more highly integrated, voltage generators that supply half voltages have to generate precise voltages and stably and promptly respond to environmental variations such as changes in production process, voltage, temperature, and load.

FIG. 1 is a circuit diagram illustrating a conventional half voltage generator.

Referring to FIG. 1, a conventional half voltage generator is formed of two resistors R1 and R2, two n-channel metal oxide semiconductor (NMOS) transistors N1 and N2, and two p-channel metal oxide semiconductor (PMOS) transistors P1 and P2. Such a conventional half voltage generator divides a voltage VCCA by using the resistors R1 and R2, and a node voltage between the NMOS transistor N1 and the PMOS transistor P1 drives a push-pull unit comprising the NMOS transistor N2 and the PMOS transistor P2 that has improved driving capacities. Accordingly, the node voltage between the NMOS transistor N1 and the PMOS transistor P1 is copied as an output voltage Vout. When the sizes of the resistances R1 and R2 are the same, the output voltage Vout becomes half (VCCA/2) of the voltage VCCA.

In the conventional half voltage generator of FIG. 1, a bias terminal through which current always flows consumes a large amount of power, and the sizes of the NMOS transistors and the PMOS transistors are increased to drive a large load. Thus, the conventional half voltage generator cannot stably and promptly respond to environmental variations, such as changes in production process, voltage, temperature, and load.

FIG. 2 is a circuit diagram illustrating another conventional half voltage generator.

The conventional half voltage generator in FIG. 2 is formed of a PMOS transistor Rp and an NMOS transistor Rn operating as loads, two NMOS transistors N1 and N2, and two PMOS transistors P1 and P2. In such a conventional half voltage generator, a bias unit comprises the PMOS transistor Rp, the NMOS transistor Rn, the NMOS transistor N1, and the PMOS transistor P1. In the bias unit, the PMOS transistor Rp and the NMOS transistor Rn operate as turn-on resistors. In addition, when the NMOS transistor N1 and the PMOS transistor P1, and the PMOS transistor Rp and the NMOS transistor Rn are symmetrically formed, a node voltage no21 becomes half of the power supply voltage VCCA/2. In this case, a second node voltage no22 and a third node voltage no23 become VCCA/2+Vtn1 and VCCA/2−Vtp1, and such node voltages no22 and no23 drive a push-pull unit comprising the NMOS transistor N2 and the PMOS transistor P2 having improved driving capacities, in order to generate an output voltage Vout. When the NMOS transistor N2 and the PMOS transistor P2 are symmetrically formed, the output voltage Vout becomes half of the power supply voltage VCCA, i.e., it becomes VCCA/2. Here, the voltages Vtn1 and Vtp1 are the threshold voltages of the NMOS transistor N1 and the PMOS transistor P1, respectively. In addition, since the half power supply voltage VCCA/2 and the power supply voltage VCCA are applied to the bulks of the PMOS transistor P1 and the PMOS transistor P2, respectively, and the threshold voltage Vtp1 of the PMOS transistor P1 is smaller than the threshold voltage Vtp2 of the PMOS transistor P2, a current path is not formed in the PMOS transistor P2. Thus, the push-pull terminals N2 and P2 consume a small amount of power. In addition, when the output voltage Vout is changed due to environmental variations, the turn on resistances of the PMOS transistor Rp and the NMOS transistor Rn are changed by a feedback operation in order to maintain the half power supply voltage VCCA/2 as the output voltage Vout.

However, the half voltage generator shown in FIG. 2 consumes a large amount of power and requires large sized NMOS transistors and PMOS transistors to have improved driving capacity. Accordingly, the half voltage generator of FIG. 2 cannot stably and promptly respond to environmental variations, such as changes in production process, voltage, temperature, and load.

The present invention provides a half voltage generator that consumes a small amount of power and stably and promptly responds to environmental variations, such as changes in production process, voltage, temperature, and load.

According to one aspect of the present invention, there is provided a half voltage generator comprising an input buffer unit, a voltage division unit, a current mirror unit, an output buffer unit, and a push-pull driving unit.

Here, the input buffer unit receives a predetermined input voltage and outputs a predetermined control voltage and a predetermined reference voltage using a power supply voltage.

The voltage division unit divides the power supply voltage in half and outputs the half power supply voltage in response to the predetermined control voltage and the predetermined reference voltage.

The current mirror unit receives the predetermined reference voltage and operates as a current mirror.

The output buffer unit is current-limited by current supplied by the current mirror unit, receives the half power supply voltage of the voltage division unit, and outputs the half power supply voltage.

The push-pull driving unit receives the half power supply voltage from the output buffer unit and outputs the half power supply voltage having improved current driving capacity.

According to another aspect of the present invention, there is provided a half voltage generator comprising an input buffer unit, a voltage division unit, a current mirror unit, an even output buffer unit, an odd output buffer unit, an even push-pull driving unit, and an odd push-pull driving unit.

Here, the input buffer unit receives a predetermined input voltage and outputs a predetermined control voltage and a predetermined reference voltage using a power voltage.

The voltage division unit divides the power supply voltage in half and outputs the half power supply voltage in response to the predetermined control voltage and the predetermined reference voltage.

The current mirror unit receives the predetermined reference voltage and operates as a current mirror.

The even output buffer unit, which is limited by current supplied by the current mirror unit, receives the half power supply voltage of the voltage division unit and outputs the half power supply voltage.

The odd output buffer unit receives the half power supply voltage from the voltage division unit and outputs the half power supply voltage.

The even push-pull driving unit receives the output voltage of the even output buffer unit and the output voltage of the odd output buffer unit and outputs the half power supply voltage having improved current driving capacity.

The odd push-pull driving unit receives the output voltage of the even output buffer unit and the output voltage of the odd output buffer unit and outputs the half power supply voltage having the improved current driving capacity.

Beneficially, the predetermined voltage comprises an array reference voltage output from an internal voltage converter (IVC) of a semiconductor memory device.

Beneficially, the input buffer unit comprises a differential amplifier having an NMOS transistor as an input terminal.

Beneficially, the voltage division unit includes more than one PMOS transistor and more than two NMOS transistors that are connected to one another in series, the PMOS transistor is controlled by the predetermined control voltage, the predetermined reference voltage is applied to the gate terminals of more than one NMOS transistor, and the half power supply voltage is output from any one source terminal of the NMOS transistors connected in series. Here, beneficially that the NMOS transistors are low threshold voltage (LTV) NMOS transistors.

Beneficially, the half power supply voltage is applied to gate terminals of more than one NMOS transistor.

Beneficially, the current mirror unit comprises a differential amplifier having an NMOS transistor as an input terminal.

Beneficially, the output buffer unit comprises a differential amplifier having a PMOS transistor as an input terminal.

Beneficially, the push-pull driving unit includes more than one PMOS transistor and more than one NMOS transistor that are connected in series.

Beneficially, the even output buffer unit comprises a differential amplifier having a PMOS transistor as an input terminal, and the odd output buffer unit comprises a differential amplifier having an NMOS transistor as an input terminal.

Beneficially, the even push-pull driving unit or the odd push-pull driving unit includes more than one PMOS transistor and more than one NMOS transistor that are connected in series.

Beneficially, the output of the even output buffer unit drives NMOS gates of the even push-pull driving unit and the odd push-pull driving unit, and the output of the odd output buffer unit drives PMOS gates of the even push-pull driving unit and the odd push-pull driving unit.

BRIEF DESCRIPTION OF THE DRAWINGS

The above aspects and advantages of the present invention will become more apparent by describing in detail preferred embodiments thereof with reference to the attached drawings in which.

DETAILED DESCRIPTION

The present invention will now be described more fully with reference to the accompanying drawings, in which preferred embodiments of the invention are shown.

Figure 1:
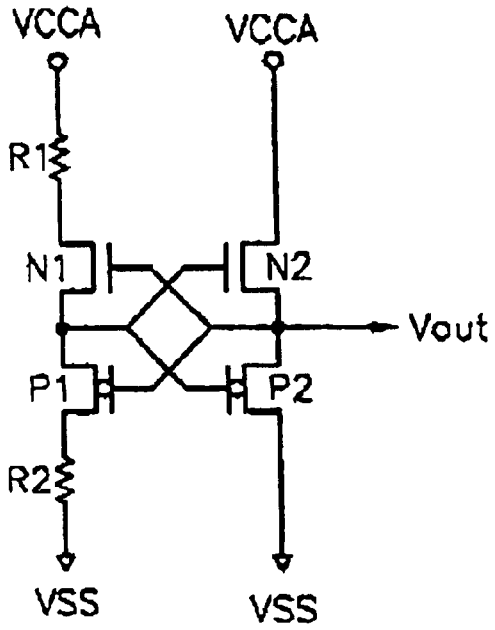
FIG. 1 (PRIOR ART)
FIG. 1 is a circuit diagram illustrating a conventional half voltage generator.
Figure 2:
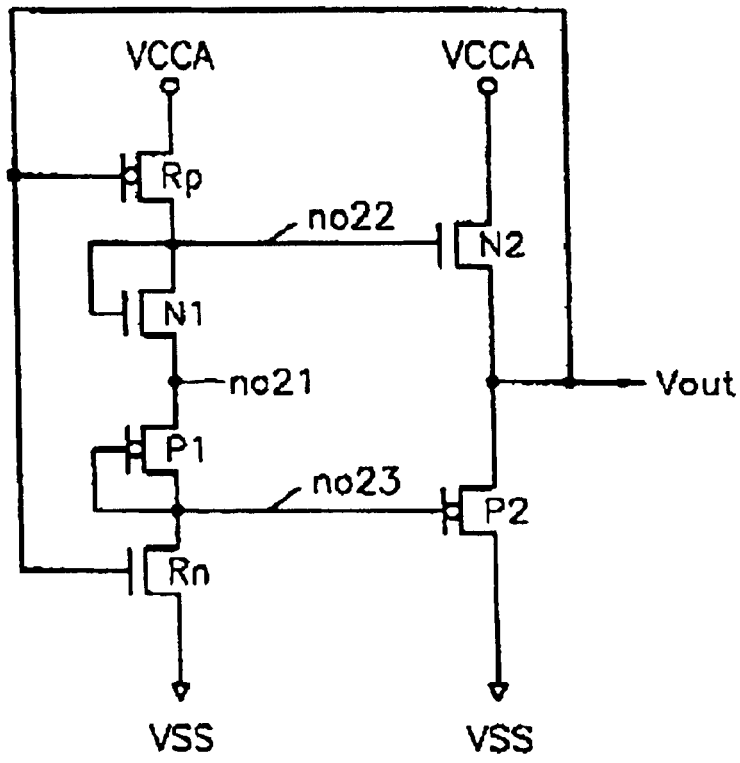
FIG. 2 (PRIOR ART)
FIG. 2 is a circuit diagram illustrating another conventional half voltage generator.
Figure 3:
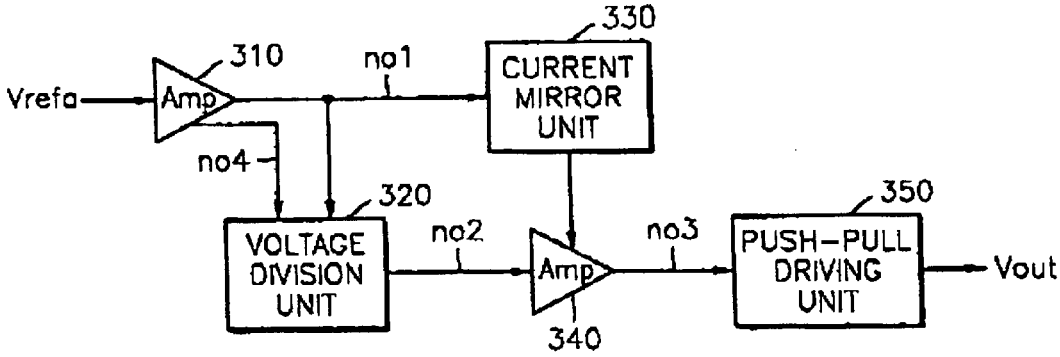
FIG. 3 is a block diagram illustrating a half voltage generator according to a first embodiment.

FIG. 3 is a block diagram illustrating a half voltage generator according to a first embodiment.

Referring to FIG. 3, a half voltage generator according to the first embodiment includes an input buffer unit 310, a voltage division unit 320, a current mirror unit 330, an output buffer unit 340, and a push-pull driving unit 350.

The input buffer unit 310 receives a predetermined voltage and outputs a predetermined control voltage no4and a predetermined reference voltage no1 using a power voltage. In this case, the input buffer unit 310 is a differential amplifier and can output a stable voltage. The predetermined input voltage is an array reference voltage Vrefa as the output voltage of an internal voltage converter (IVC) in a semiconductor memory device, or any DC voltage. The IVC of the semiconductor memory device supplies a constant array reference voltage regardless of changes in an external voltage. So that the IVC prevents the semiconductor memory device from operating incorrectly even when the capacity of the memory is high and the memory is highly integrated in order to improve the reliability of the product. In addition, the power supply voltage VCCA, which is opposite from a ground voltage, is denoted by a voltage that supplies power commonly used in the half voltage generator. The predetermined control voltage controls the voltage division unit 320.

The voltage division unit 320 divides the power supply voltage in half in response to the predetermined control voltage no4 and reference voltage no1 that are generated by the input buffer unit 310, and outputs the divided voltage no2. Here, the divided output voltage corresponds to (VCCA−VSS)/2.

The current mirror unit 330 receives the predetermined reference voltage no1 that is generated by the input buffer unit 310, and operates as a current mirror. Here, the current of an output terminal of the current mirror is determined based on the control of an input terminal.

The operation of the output buffer unit 340 is limited by the current of the current mirror unit 330 and controlled by the output voltage no2 of the voltage division unit 320 in order to output a voltage that is half of the power supply voltage. Here, the output buffer unit 340 outputs a stable voltage by using a differential amplifier. In addition, the output buffer unit 340 is limited by the current of the current mirror unit 330 in order to prevent problems of a conventional half voltage generator, such as increasing power dissipation due to operating bias terminals without current limits.

The push-pull driving unit 350 is controlled by the output voltage no3 of the output buffer unit 340 to output a half power supply voltage. The push-pull driving unit 350 operates as a buffer that outputs the same voltage as the voltage at its input terminal, while increasing the current driving capacity by using large PMOS transistors and NMOS transistors.

Figure 4:
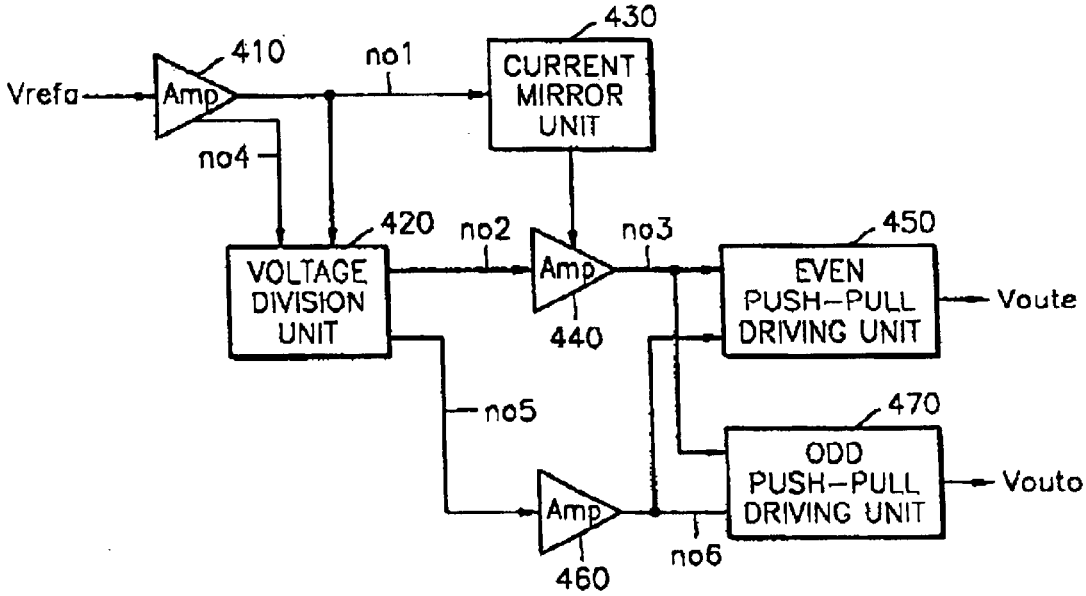
FIG. 4 is a block diagram illustrating a half voltage generator according to a second embodiment.

FIG. 4 is a block diagram illustrating a half voltage generator according to a second embodiment.

Referring to FIG. 4, a half voltage generator according to the second embodiment includes an input buffer unit 410, a voltage division unit 420, a current mirror unit 430, an even output buffer unit 440, an even push-pull driving unit 450, an odd output buffer unit 460, and an odd push-pull driving unit 470. The half voltage generator of FIG. 4 is formed by adding one output buffer unit and one push-pull driving unit to the half voltage generator of FIG. 3 so that the half voltage generator of FIG. 4 can drive more than two banks in semiconductor memory devices.

The operations of the input buffer unit 410, the voltage division unit 420, and the current mirror unit 430 are the same as those in the half voltage generator of FIG. 3.

The input buffer unit 410 receives a predetermined voltage and outputs a predetermined control voltage no4and a predetermined reference voltage no1 using a power supply voltage. Here, the input buffer unit 410 is a differential amplifier and outputs a stable voltage. In addition, the predetermined input voltage is an array reference voltage Vrefa as an output voltage of an IVC in a semiconductor memory device, or any DC voltage. The other operations of the input buffer unit 410 are the same as those of the input buffer unit 310 shown in FIG. 3.

The voltage division unit 420 divides the power voltage in half and outputs the half power supply voltage in response to the predetermined control voltage no4 and the reference voltage no1 that are generated by the input buffer unit 410.

The current mirror unit 430 receives the predetermined reference voltage no1 that is generated by the input buffer unit 410, and operates as a current mirror.

The operation of the even output buffer unit 440 is limited by the current of the current mirror unit 430 and controlled by the output voltage of the voltage division unit 420, and outputs the half power supply voltage. Here, the even output buffer unit 440 outputs a stable voltage by using a differential amplifier. In addition, the even output buffer unit 440 is limited by the current of the current mirror unit 430 in order to prevent problems of the conventional half voltage generator, such as increasing power dissipation due to operating bias terminals without current limits.

The odd output buffer unit 460 is controlled by the output voltage of the voltage division unit 420, and outputs the half power supply voltage. Here, the odd output buffer unit 460 outputs a stable voltage by using a differential amplifier.

The even push-pull driving unit 450 is controlled by the output voltages no3, no6 of the even output buffer unit 440 and the odd output buffer unit 460, and outputs the half power supply voltage.

The odd push-pull driving unit 470 also is controlled by the output voltages no3, no6 of the even output buffer unit 440 and the odd output buffer unit 460, and outputs the half power supply voltage.

The even push-pull driving unit 450 and the odd push-pull driving unit 470 operate as buffers that each output the same voltage as the voltage at its input terminal by increasing a current driving capacity by using large PMOS transistors and NMOS transistors.

The operation of the half voltage generator will now be described.

Figure 5:
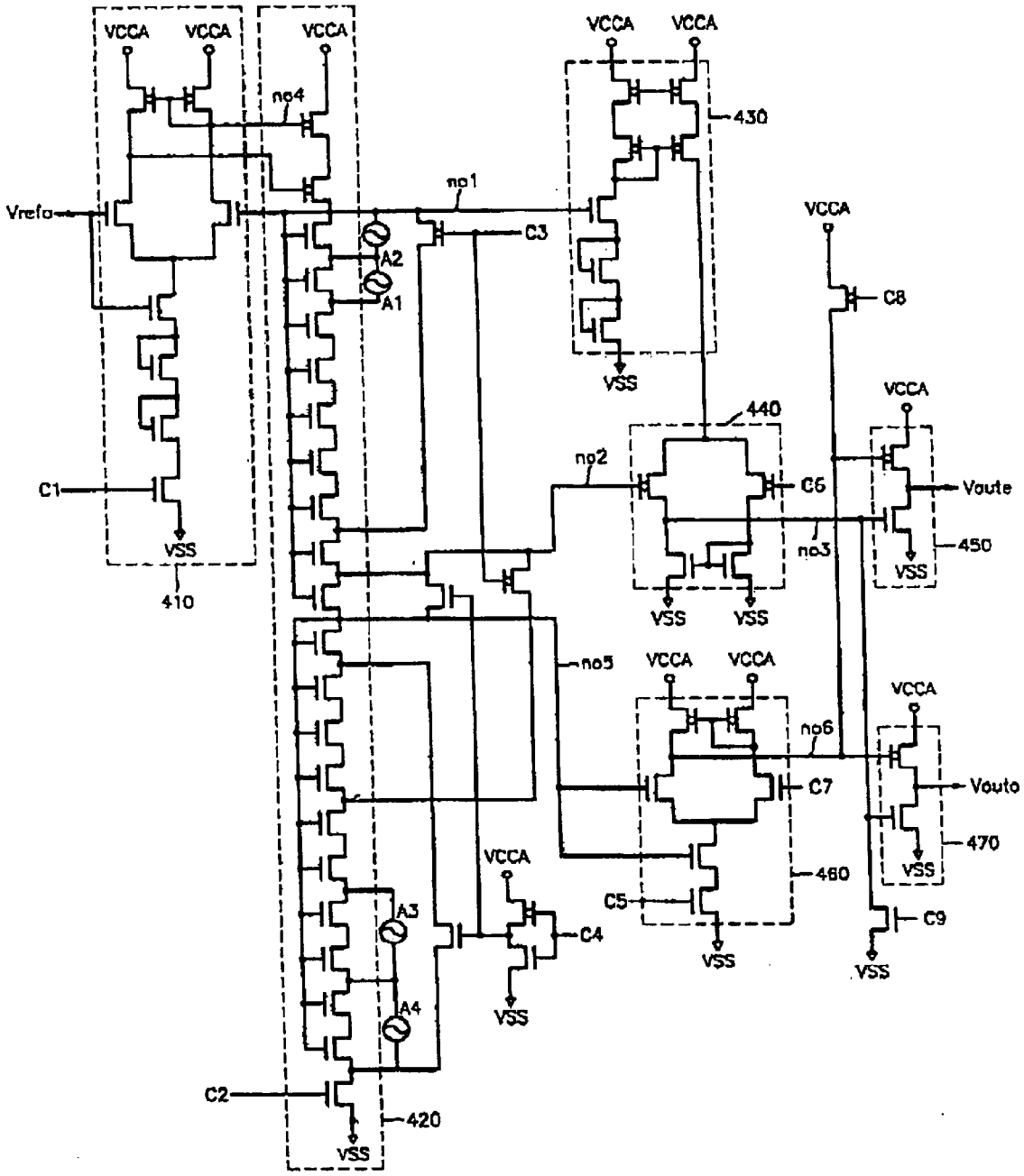
FIG. 5 is a circuit diagram illustrating the half voltage generator of FIG. 4.

FIG. 5 is a circuit diagram illustrating the half voltage generator of FIG. 4. Since the half voltage generator according to the first embodiment shown in FIG. 3 corresponds to a portion of the half voltage generator of FIG. 4, the circuit diagram of the half voltage generator of FIG. 3 will be described when describing the circuit diagram of the half voltage generator shown in FIG. 4.

Referring to FIG. 5, the input buffer unit 410 that is formed of an NMOS input stage differential amplifier outputs a stable reference voltage no1 using the input voltage in response to the output voltage of the IVC, and outputs the predetermined control voltage using the power supply voltage. Here, the predetermined control voltage denotes a voltage that controls the PMOS transistor of the voltage division unit 420, which is connected in series to the power supply voltage VCCA. In addition, the predetermined control voltage affects the output of the predetermined reference voltage that is slightly smaller than the power voltage VCCA. Here, for the convenience of description, control signals C1 through C9, and circuits connected to the control signals C1 through C9, are added, and it is assumed that the operations of the control signals C1 through C9 and the circuits are controlled for the operation of the half voltage generator. Suitable voltage levels for the normal operation of the half voltage generator may bias the control signals C1 through C9. For example, the operation of the odd output buffer unit 460 is controlled by the control signal C5 and limited by the current corresponding to the voltage level of the control signal C5.

The predetermined reference voltage no1 from the input buffer unit 410 is input to the voltage division unit 420, and the voltage division unit 420 outputs the half power supply voltage VCCA/2 to the even output buffer unit 440 and the odd output buffer unit 460. Here, the even output buffer unit 440 is formed of a PMOS input stage differential amplifier and the odd output buffer unit 460 is formed of an NMOS input stage differential amplifier.

The voltage division unit 420 includes more than one PMOS transistor and more than two low threshold voltage (LVT) NMOS transistors that are connected to one another in series. The PMOS transistors are controlled by the predetermined control voltage no4 from the input buffer unit 410, and the predetermined reference voltage no1 of the input buffer unit 410 is connected to the gate terminals of more than one LVT NMOS transistor. The half power supply voltage VCCA/2 of the power voltage VCCA is output from the source terminal of any one of the LVT NMOS transistors that are connected in series. In addition, the half power supply voltage VCCA/2 of the power voltage VCCA is connected to the gate terminal of more than one LVT NMOS transistor. In other words, the half power supply voltage VCCA/2 is output from the source terminal of any one of the LVT NMOS transistors, in response to the sizes of the PMOS transistor and the LVT NMOS transistor, which are connected to each other in series while serving as resistors, and transistor characteristics, such as the thickness of gate oxide layers, the threshold voltage, and doping concentration. Here, the LVT NMOS transistor denotes an NMOS transistor having a low threshold voltage. The threshold voltage of general NMOS transistors is 0.6 to 0.7 V; however, the threshold voltage of an LVT NMOS transistor is lower than 0.5 V. When the voltage is divided using the LVT NMOS transistor, the voltage can be precisely divided by lowering unstable factors that are caused by uneven processes.

The predetermined reference voltage no1 from the input buffer unit 410 is also input to the current mirror unit 430 that is formed of a differential amplifier having an NMOS transistor as an input terminal. Accordingly, the current mirror unit 430 operates as the current mirror. In addition, the amount of current determined by the current mirror unit 430 limits the amount of current to the output buffer unit 440. Thus, the bias terminals of the half voltage generator consume a smaller amount of power than the bias terminals of the conventional half voltage generator as described above.

The even output buffer unit 440 and the odd output buffer unit 460 are each controlled by the half power supply voltage VCCA/2 from the voltage division unit 420 to output the stable half power supply VCCA/2. Here, differential amplifiers are used in the even output buffer unit 440 and the odd output buffer unit 460 to output voltages that stably and promptly respond regardless of environmental variations, such as changes in production process, voltage, temperature, and load.

Thus, due to improved current driving capacities, the even push-pull driving unit 450 and the odd push-pull driving unit 470, which receive the outputs of the even output buffer unit 440 and the odd output buffer unit 460, respectively, output final output voltages Voute and Vouto, which are the same as the input voltages. Here, the output of the even output buffer unit 440 drives the NMOS gates of the even push-pull driving unit 450 and the odd push-pull driving unit 470, and the output of the odd output buffer unit 460 drives the PMOS gates of the even push-pull driving unit 450 and the odd push-pull driving unit 470. Thus, the final output voltages Voute and Vouto from the even push-pull driving unit 450 and the odd push-pull driving unit 470 are the same.

On the other hand, in order to output one final output voltage Vout as in the case of the half voltage generator of FIG. 3, the odd output buffer 460 and the odd push-pull driving unit 470 are removed. In this case, the output of the even output buffer unit 440 has to drive both the NMOS gate and PMOS gate of the even push-pull driving unit 450.

As described above, when the input buffer 310 or 410 receives a predetermined voltage and outputs a predetermined control voltage no4 and a predetermined reference voltage no1 using a power supply voltage, the voltage division unit 320 or 420 divides the power supply voltage in half and outputs the divided voltage in response to the predetermined control voltage no4 and reference voltage no1, which are generated by the input buffer unit 310 or 410. Thus, when the current mirror unit 330 or 430 receives the predetermined reference voltage no1 generated by the input buffer unit 310 or 410 and operates as a current mirror, the operation of the output buffer unit 340, 440, or 460 is limited by the currents of the current mirror unit 330 or 430 and controlled by the output voltage no2/no5 of the voltage division unit 320 or 420 in order to output a voltage which is half of the power supply voltage. Thereafter, the push-pull driving unit 350, 450, or 470 is controlled by the output voltage no3/no6 of the output buffer unit 340, 440, or 460 to output the voltage which is half of the power supply voltage, which has improved current driving capacities, as the final output voltage.

As described above, since the half voltage generator is formed of the LVT NMOS voltage division unit, the current mirror, and the differential amplifier, the half voltage generator consumes a small amount of power and generates a half power supply voltage that stably and promptly responds regardless of environmental variations, such as changes in production process, voltage, temperature, and load. Therefore, the half power supply voltage generated by the half voltage generator can be used as a precharge power voltage that is supplied to an array of semiconductor memory devices.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A half voltage generator comprising:

an input buffer unit adapted to receive an input voltage and adapted to output a control voltage and a reference voltage using a power supply voltage;

a voltage division unit adapted to divide the power supply voltage in half and adapted to output the half power supply voltage in response to the control voltage and the reference voltage;

a current mirror unit adapted to receive the reference voltage and operating as a current mirror;

an output buffer unit adapted to receive current from the current mirror unit so as to be current limited, adapted to receive the half power supply voltage of the voltage division unit, and adapted to output the half power supply voltage; and a push-pull driving unit, adapted to receive the half power supply voltage from the output buffer unit and adapted to output the half power supply voltage having improved current driving capacity with respect to the half power supply voltage received from the output buffer unit.

2. The half voltage generator of claim 1, wherein the input voltage is an array reference voltage output from an internal voltage converter (IVC) of a semiconductor memory device.

3. The half voltage generator of claim 1, wherein the input buffer unit is a differential amplifier having an NMOS transistor as an input terminal.

4. The half voltage generator of claim 1, wherein the voltage division unit includes more than one PMOS transistor and more than two NMOS transistors that are connected to one another in series, wherein the PMOS transistor is adapted to be controlled by the control voltage, wherein gate terminals of more than one of the NMOS transistors are adapted to receive the reference voltage, and any source terminal of one of the NMOS transistors connected in series is adapted to output the half power supply voltage.

5. The half voltage generator of claim 4, wherein the NMOS transistors are low threshold voltage (LVT) NMOS transistors.

6. The half voltage generator of claim 5, wherein gate terminals of more than one of the NMOS transistors are adapted to receive the half power supply voltage.

7. The half voltage generator of claim 1, wherein the current mirror unit includes a differential amplifier having an NMOS transistor as an input terminal.

8. The half voltage generator of claim 1, wherein the output buffer unit includes a differential amplifier having a PMOS transistor as an input terminal.

9. The half voltage generator of claim 1, wherein the push-pull driving unit includes more than one PMOS transistor and more than one NMOS transistor that are connected in series.

10. A half voltage generator comprising:

an input buffer unit adapted to receive an input voltage and adapted to output a control voltage and a reference voltage using a power supply voltage;

a voltage division unit adapted to divide the power supply voltage in half and adapted to output the half power supply voltage in response to the control voltage and the reference voltage;

a current mirror unit adapted to receive the reference voltage and operating as a current mirror;

an even output buffer unit adapted to receive current from the current mirror unit so as to be current limited, adapted to receive the half power supply voltage from the voltage division unit, and adapted to output the half power supply voltage;

an odd output buffer unit, adapted to receive the half power supply voltage from the voltage division unit and adapted to output the half power supply voltage;

an even push-pull driving unit, adapted to receive the output voltage of the even output buffer unit and the output voltage of the odd output buffer unit, and adapted to output the half power supply voltage having improved current driving capacity with respect to the half power supply voltage received from the even output buffer unit; and an odd push-pull driving unit, adapted to receive the output voltage of the even output buffer unit and the output voltage of the odd output buffer unit and adapted to output the half power supply voltage having the improved current driving capacity with respect to the half power supply voltage received from the odd output buffer unit.

11. The half voltage generator of claim 10, wherein the even output buffer unit includes a differential amplifier having a PMOS transistor as an input terminal, and the odd output buffer unit includes a differential amplifier having an NMOS transistor as an input terminal.

12. The half voltage generator of claim 10, wherein the at least one of the even push-pull driving unit and the odd push-pull driving unit has more than one PMOS transistor and more than one NMOS transistor that are connected in series.

13. The half voltage generator of claim 10, wherein the output of the even output buffer unit is adapted to drive NMOS gates of the even push-pull driving unit and the odd push-pull driving unit, and the output of the odd output buffer unit is adapted to drive PMOS gates of the even push-pull driving unit and the odd push-pull driving unit.

14. The half voltage generator of claim 10, wherein the input voltage is an array reference voltage output from an internal voltage converter (IVC) of a semiconductor memory device.

15. The half voltage generator of claim 10, wherein the input buffer unit is a differential amplifier having an NMOS transistor as an input terminal.

16. The half voltage generator of claim 10, wherein the voltage division unit includes more than one PMOS transistor and more than two NMOS transistors that are connected to one another in series, wherein the PMOS transistor is adapted to be controlled by the control voltage, wherein gate terminals of more than one of the NMOS transistors are adapted to receive the reference voltage, and any source terminal of one of the NMOS transistors connected in series is adapted to output the half power supply voltage.

17. The half voltage generator of claim 16, wherein the NMOS transistors are low threshold voltage (LVT) NMOS transistors.

18. The half voltage generator of claim 17, wherein gate terminals of more than one of the NMOS transistors are adapted to receive the half power supply voltage.

19. The half voltage generator of claim 10, wherein the current mirror unit includes a differential amplifier having an NMOS transistor as an input terminal.

20. The half voltage generator of claim 10, wherein the output buffer unit includes a differential amplifier having a PMOS transistor as an input terminal.

21. The half voltage generator of claim 10, wherein the push-pull driving unit includes more than one PMOS transistor and more than one NMOS transistor that are connected in series.

* * * * *